United States Patent [19]

Trojan

[11] Patent Number: 4,645,540

[45] Date of Patent: Feb. 24, 1987

[54] CONTINUOUSLY OPERATING CENTRIFUGE

[75] Inventor: Günter Trojan, Bochum, Fed. Rep. of Germany

[73] Assignee: Hein, Lehmann AG, Dusseldorf, Fed. Rep. of Germany

[21] Appl. No.: 702,451

[22] Filed: Feb. 19, 1985

[30] Foreign Application Priority Data

Feb. 17, 1984 [DE] Fed. Rep. of Germany ..... 3405752

[51] Int. Cl.[4] ..... C13F 1/06

[52] U.S. Cl. ..... 127/19; 494/70

[58] Field of Search ..... 127/9, 19, 56; 494/13, 494/71, 70, 25, 68; 210/369

[56] References Cited

U.S. PATENT DOCUMENTS

| | | | |
|---|---|---|---|
| 3,955,754 | 5/1976 | Schaper | 127/19 |
| 3,970,470 | 7/1976 | Trojan et al. | 127/19 |
| 3,973,984 | 8/1976 | Hentschel | 127/19 |
| 4,063,959 | 12/1977 | Dietzel et al. | 127/19 |
| 4,205,999 | 6/1980 | Zeichner et al. | 127/19 |
| 4,209,341 | 6/1980 | Houben | 127/19 |
| 4,332,621 | 6/1982 | Kurland et al. | 127/19 |
| 4,375,990 | 3/1983 | Price et al. | 127/19 |
| 4,409,031 | 10/1983 | Schaper | 127/19 |
| 4,443,266 | 4/1984 | Schaper et al. | 127/19 |

FOREIGN PATENT DOCUMENTS

| | | | |
|---|---|---|---|
| 2841725 | 4/1980 | Fed. Rep. of Germany | 127/19 |

*Primary Examiner*—R. B. Penland

*Attorney, Agent, or Firm*—Karl F. Ross; Herbert Dubno

[57] ABSTRACT

The invention relates to a continuously operating centrifuge having a centrifuge basket, a feed tube for the charge, reaching into the basket, and an accelerating and heating device arranged at the bottom of the basket, which device has, coaxial to the basket, rings of various diameter arranged concentrically one in the other, the inside walls of which conically widen downwards and before the lower horizontal edge of which the charge is centrifuged to the ring lying further outside. More than two rings are arranged, the spaces between the rings being open upwards and downwards. The rings have an upper free horizontal centrifuging edge, and a steam feed tube is arranged off-center through which steam is brought into the annular spaces from above.

7 Claims, 3 Drawing Figures

CONTINUOUSLY OPERATING CENTRIFUGE

FIELD OF THE INVENTION

The invention relates to a continuously operating centrifuge, in particular a sugar centrifuge, having a centrifuge basket, a feed tube for the charge reaching into the basket, and an accelerating and heating device arranged at the bottom of the basket. The device has, coaxial with the basket, rings of various diameter arranged concentrically one in another, the inside walls of which conically widen downward and before the bottom horizontal edge of which the charge is centrifuged to the ring lying further outside.

BACKGROUND OF THE INVENTION

Such a centrifuge is known from German Offenlegungsschrift No. 2,328,830. The accelerating device arranged there at the bottom of the centrifuge basket has rings of triangular cross section fixed alternately to the bottom and to an upper ring plate, producing a maximum of four trajectories for the charge. Also known from German Offenlegungsschrift No. 2,841,725 is to provide an accelerating device with conical, coaxial areas of sheet metal, which produce two trajectories.

OBJECT OF THE INVENTION

The object of the invention is to improve a centrifuge of the type described but such that a considerably greater number of trajectories are produced in minimum space within the accelerating and heating device than was hitherto possible, and to feed the steam in such a way that it comes into contact with the freely flying charge of all trajectories.

SUMMARY OF THE INVENTION

Trajectories are of great significance for the effectiveness of the heating device. At these trajectories, the charge forms a very thin, freely flying layer which offers a large surface to the steam. The heat transmission therefore takes place very effectively, to be precise, the more effectively the more trajectories are available.

By the construction according to the invention, the number of trajectories is about twice the number of rings. This makes it possible to produce many trajectories of the charge or charge mist, in a very small space. At the same time, the apparatus is of extremely simple construction. A very even feed of the charge onto the basket is also achieved and the charge is intimately mixed with water. In a constructionally simple way, water vapour can be brought through upward-open rings into the spaces between the rings and thus into the trajectories, so that an optimum heat transmission to the charge is achieved. Moreover, the upwardly open spaces between the rings ensure that, in the event of a blockage of charge within the accelerating device, the charge can easily escape upwards.

According to the invention, more than two rings are provided so that the spaces between the rings are open upwardly, the rings have an upper, free horizontal centrifuging edge, and a steam feed tube is arranged off-center or excentrically, through which steam can be introduced into the annular spaces from above.

A reliable transfer of the charge by trajectories in the lower region of the rings is created by the ring lying further outside, in each case protruding more deeply into the basket with its horizontal, free bottom edges than the free bottom edge of the ring lying further inside innermost rings. A transfer in the upper region is achieved by the horizontal, free top edge of the outer ring, in each case at a higher level than the free top edge of the ring lying further inside.

A structurally simple design of low dimensions and low weight is achieved by the rings being formed from conically bent sheet metal strips. In this case, the height of the rings can increase from inside to outside.

Preferably, the rings are fixed to each other in the middle region. This means that the fixing elements are located in an area where they cause very little disruption to the even flow of the charge. In particular, it is proposed in this respect that radial rods pass through the rings for fixing them.

An optimum fixing of the rings at the basket bottom is achieved by the innermost ring being borne by a conically upward-widening, hollow coaxial support cone which is fixed to the bottom of the basket, is surrounded by the innermost ring and has at least three openings in its wall. Moreover, this causes the charge to be evenly distributed. It is also proposed in this respect that the openings have a greater length than height and extend horizontally in their length.

In order to be able to divert the charge jet entering the accelerating device at the required height and distribute it evenly, it is proposed that a circular, horizontal plate, elevated with respect to the basket bottom, be coaxially fixed within the rings, in particular of the support cone.

This centrifuge can be used particularly advantageously for the processing of highly viscous charges.

BRIEF DESCRIPTION OF THE DRAWING

Two exemplary embodiments of the invention are described in more detail below and are illustrated in the drawing, in which.

SPECIFIC DESCRIPTION

Figure 1:
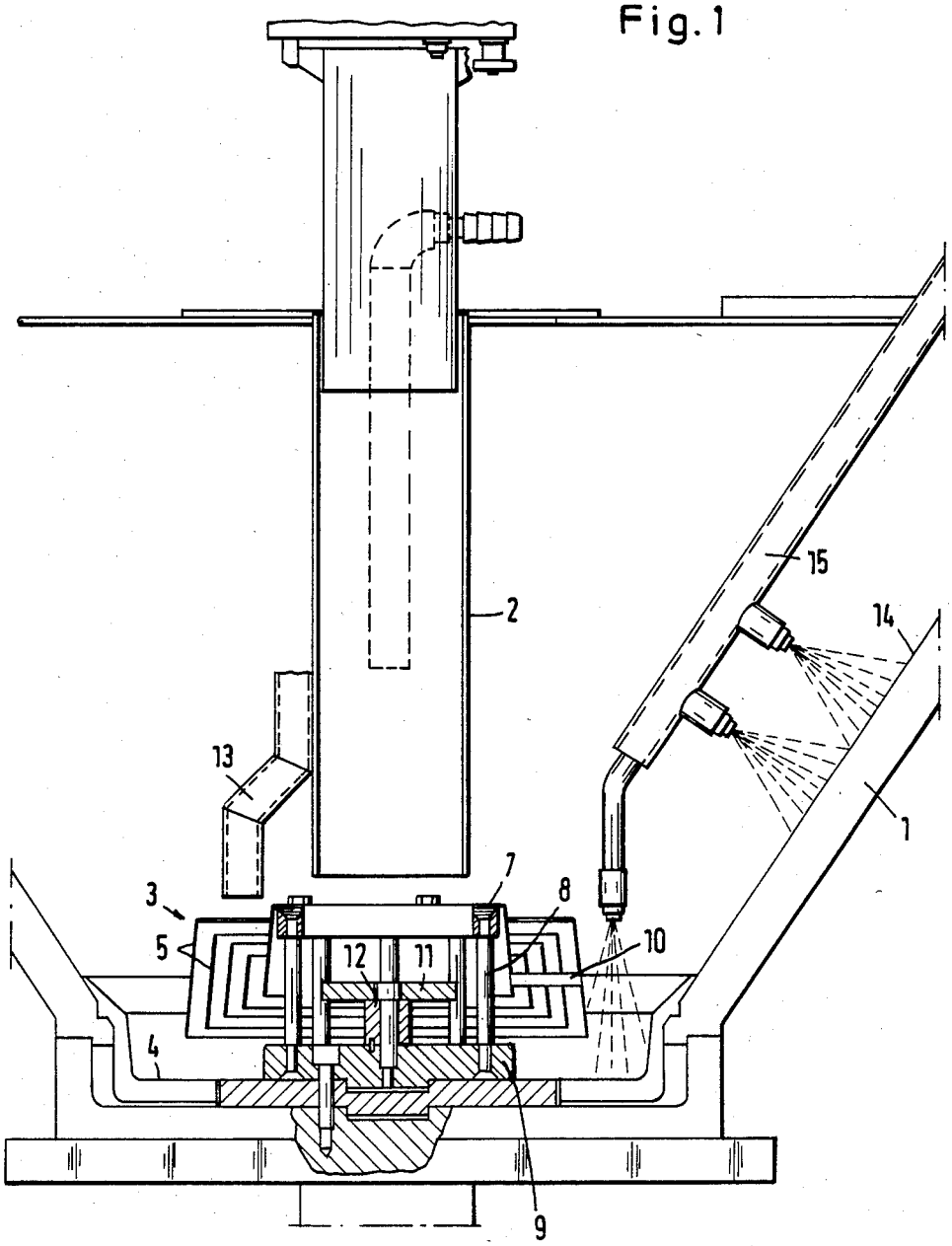
FIG. 1 shows a highly diagrammatic vertical section through the centrifuge basket with the basket wall on the right-hand side just partially shown.

The continuously operating sugar centrifuge has a conically upwardly widening centrifuge basket 1 which rotates about a vertical axis. Protruding into the basket 1 coaxially from above is a feed tube 2, through which the charge flows centrally into an accelerating device 3 which is fixed on the bottom 4 of the basket.

In this embodiment, the accelerating device 3 has 5 bent rings 5 of sheet steel, which are of circular cross section, are arranged coaxial to the rotational axis of the basket 1 and which conically taper upwards. The inside walls of the rings 5 are parallel to one another, so that the rings form annular spaces 6 between themselves. The walls of the spaces form an angle of about 6° to the vertical. The annular spaces 6 are open upwardly and downwardly.

Apart from the innermost ring 5*a*, having the smallest diameter, the heights of the rings 5 are increased to stops constantly radially outwardly, the upper, free horizontal edges of the rings 5*b*–5*e* being at a higher level from ring to ring and, likewise, the lowest horizontal edges of the rings being at a lower level from ring to ring toward the outside, so that the rings increase in their height in stages at the top and bottom. Only the innermost ring 5*a* has a higher upper edge than the second ring 5*b*, to which edge a horizontal fixing ring is welded which is held by the upper ends of vertical rods 8 arranged axially parallel, off-center in a circle and stand on the bottom 4 or are screwed into a plate 9 standing on the bottom. On the innermost ring 5*a*, the rings 5*b*–5*e* lying further outside are fixed by means of radial rods 10 which are arranged approximately centrally between the upper and lower edges of the rings 5 and pass through the rings 5*b*–5*d*.

The charge (not shown) flows through the feed tube 2 downwards without normally touching the walls of the tube 2, and passes through the central opening of the fixing ring 7 into the accelerating device 3. There it meets a circular, coaxial horizontal plate 11 of a coaxial table which is screwed onto the plate 9 by its foot 12. The plate 11 rotating with the basket 1 causes the charge jet to be deflected horizontally to all sides and hit the inside of the innermost ring 5*a*. Since this surface conically widens downwards, the charge is driven down and reaches the lower horizontal edge of the ring 5*a*, from which it is centrifuged horizontally in a mist, until it hits the inside wall of the ring 5*b*. The charge thus traverses the innermost annular space 6*a* in free flight and, in the process, water vapor flows through it. The water vapor is introduced from above into the intermediate spaces 6 through a steam feed tube 13. This steam feed tube lies to one side of the charge feed tube 2.

The charge meeting the inside wall of the ring 5*b* is transported by its conicity not only downwards to the lower horizontal edge of the ring 5*b*, but, from a certain charge quantity, to the upper free horizontal edge of the ring 5*b* as well. Thus, charge is issued as a mist both from the upper and from the lower free edges of the ring 5*b* onto the ring 5*c*, and from the latter in the same way onto the ring 5*d*, and finally from the latter onto the ring 5*e*. The rings 5*b*–5*d* thereby form six areas of mist or trajectories. Added to this are the two trajectories of the lower edges of rings 5*a* and 5*e*. In the case of each of these trajectories, the charge mist is interspersed with steam.

From the lower horizontal free edge of the outermost ring 5*e*, the, in the meantime very evenly distributed, charge flies onto the conically upward-widening side wall of the pot-shaped bottom of the basket 1, and from there onto the inwardly adjacent sieve 14 of the basket 1. In these areas, cold or warm water is sprayed onto the charge through a line 15 having several outlet openings.

Figure 2:
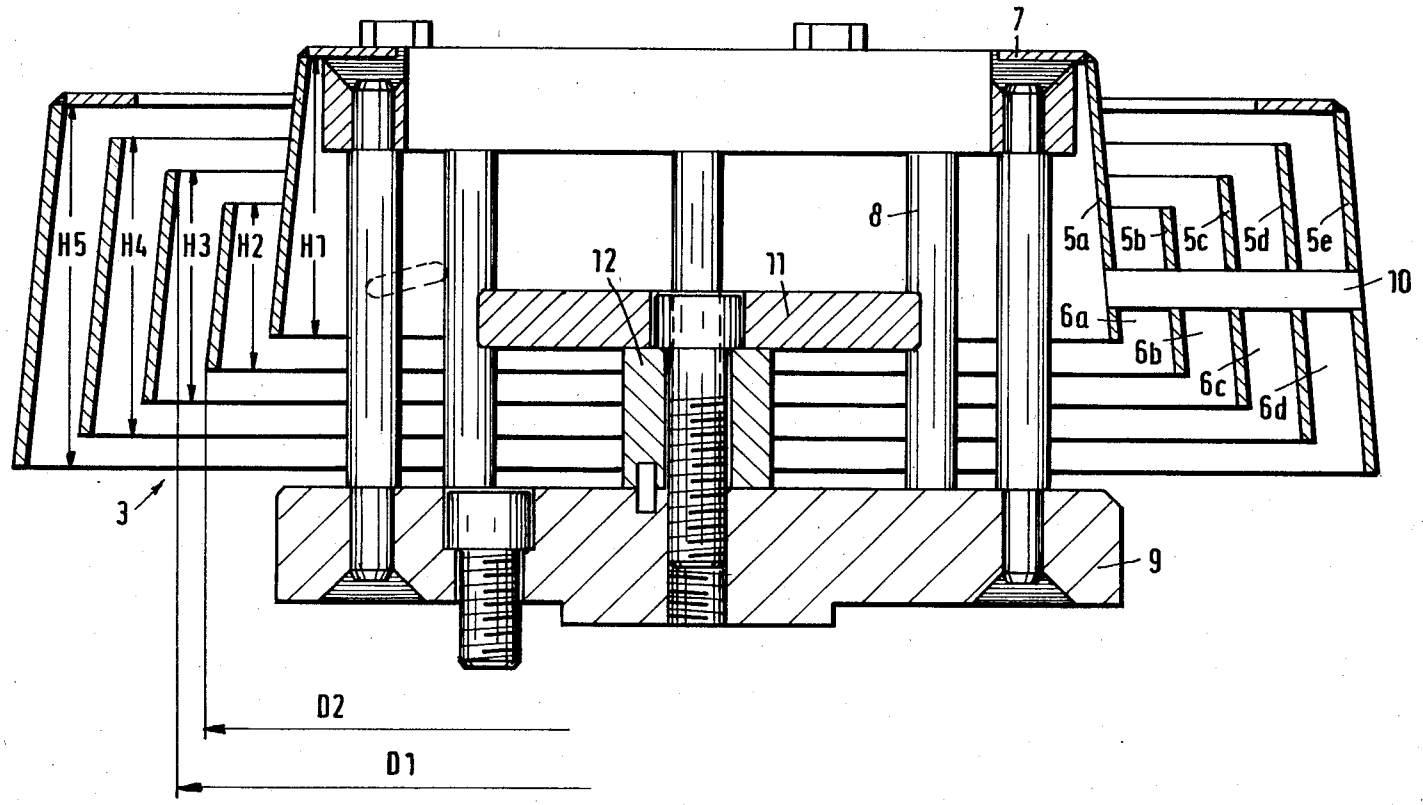
FIG. 2 shows a section from FIG. 1 in the region of the accelerating device.
Figure 3:
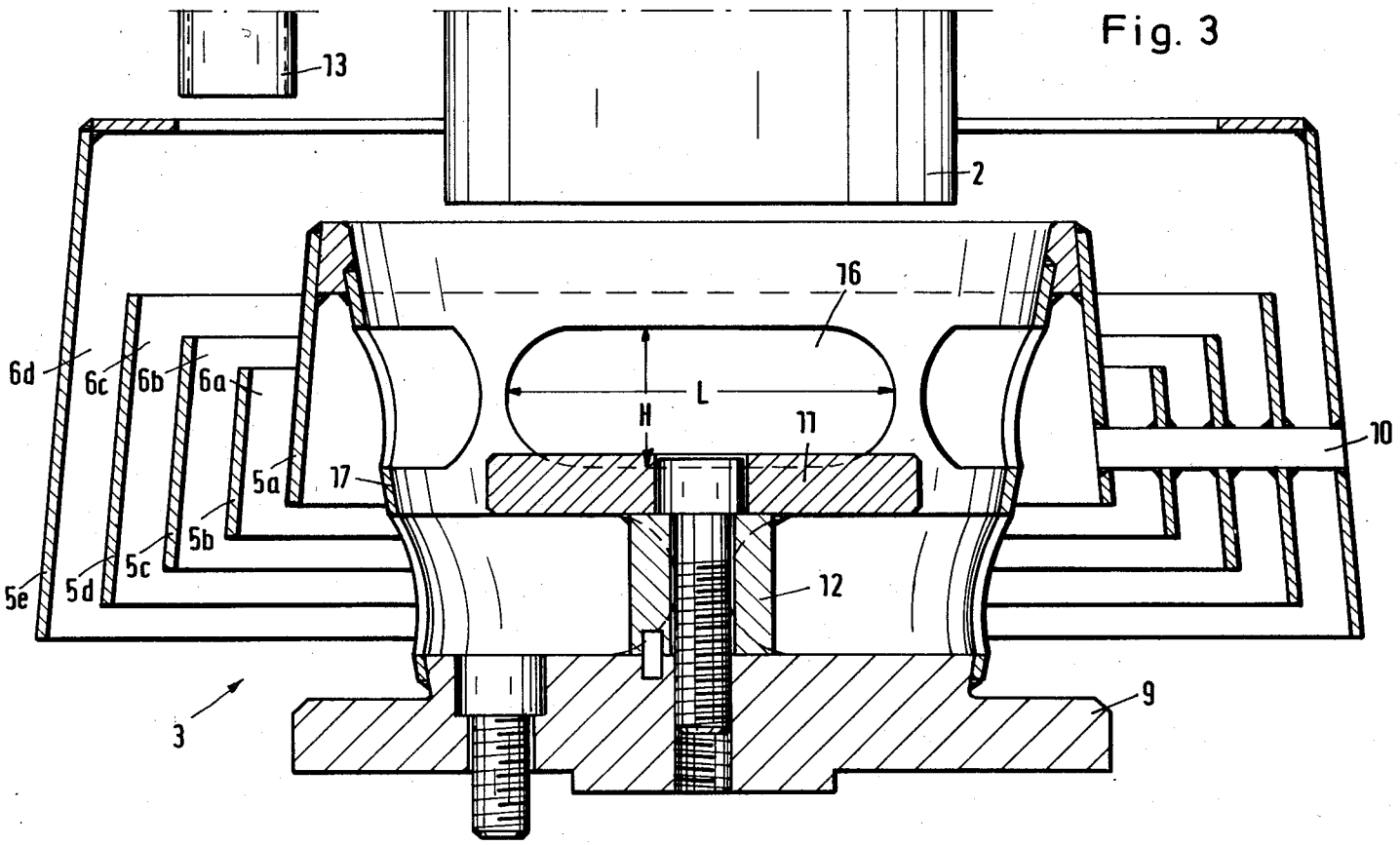
FIG. 3 shows a section as per FIG. 2 of an alternative construction.

The alternative illustrated in FIG. 3 differs from those according to FIGS. 1 and 2 in that the innermost ring 5*a* is not fixed by means of rods 8, but by means of a conically upward-widening, hollow support cone of bent metal sheet on the bottom 4 which has openings 16 in two horizontal rows one above the other, the length L of which openings is greater in the horizontal direction than their height H. The openings 16 are rounded off on their narrow sides, and the lower horizontal edge of the openings 16 of the upper row is approximately on a level with the top side of the plate 11.

I claim:

1. A continuously operating sugar centrifuge comprising:

a downwardly extending feed tube terminating at a lower end for discharging a flowable material to be centrifuged;

a centrifuge basket rotatable about an axis along which said feed tube extends and provided with:

a plate disposed immediately below said end of said feed tube for discharging said material outwardly, an inner ring surrounding said plate and having a lower edge located below said plate at which said material, intercepted by said inner ring, is deflected outwardly, and at least two further rings with downwardly divergent frustoconical flanks coaxial with said inner ring and spaced from one another and from said inner ring, said further rings having upper edges lying above said lower edge of said inner ring and lower edges lying below said lower edge of said inner ring and wherein each more outwardly arranged ring of said further rings has an upper edge above and a lower edge below the respective edges of the next most inwardly ring whereby respective streams of said material pass from said lower edge of said inner ring across a space between said inner ring and an innermost one of said further rings and from both said edges of each of said further rings centrifugally outwardly; and a downwardly positioned steam inlet tube disposed excentrically with respect to said axis and laterally spaced from said feed tube while opening downwardly into spaces between said rings for treating said streams with steam.

2. The centrifuge defined in claim 1 wherein the maximum diameter of each of said flanks is less than the minimum diameter of a next more outwardly flank.

3. The centrifuge defined in claim 1 wherein said further rings have heights increasing from further ring to further ring outwardly.

4. The centrifuge defined in claim 1, further comprising radial rods passing through said rings for fastening them together.

5. The centrifuge defined in claim 1 wherein said inner ring is carried by a conically upwardly widening hollow coaxial support cone surrounded by said inner ring, mounted on a base plate and provided with at least three openings dispensing said material toward said inner ring.

6. The centrifuge defined in claim 5 wherein said openings are horizontally elongated.

7. The centrifuge defined in claim 6 wherein said plate is mounted inside said support cone substantially at the level of said openings.

* * * * *